US009875684B2

(12) United States Patent
Meng

(10) Patent No.: US 9,875,684 B2
(45) Date of Patent: Jan. 23, 2018

(54) ARRAY SUBSTRATE, ITS DRIVING METHOD, AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Zhaohui Meng, Beijing (CN)

(73) Assignees: BOE TECHNOLOGY GROUP CO., LTD. (CN); BEIJING BOE OPTOELECTRONICS TECHNOLOGY CO., LTD. (CN)

( * ) Notice: Subject to any disclaimer, the term of this patent is extended or adjusted under 35 U.S.C. 154(b) by 176 days.

(21) Appl. No.: 14/427,167

(22) PCT Filed: Jul. 3, 2014

(86) PCT No.: PCT/CN2014/081552
§ 371 (c)(1),
(2) Date: Mar. 10, 2015

(87) PCT Pub. No.: WO2015/109767
PCT Pub. Date: Jul. 30, 2015

(65) Prior Publication Data

US 2016/0027374 A1 Jan. 28, 2016

(30) Foreign Application Priority Data

Jan. 27, 2014 (CN) ..... 2014 1 0040302

(51) Int. Cl.
*G09G 3/32* (2016.01)
*G09G 5/02* (2006.01)
(Continued)

(52) U.S. Cl.
CPC ..... *G09G 3/32* (2013.01); *G09G 3/2003* (2013.01); *G09G 3/3225* (2013.01); *G09G 5/02* (2013.01);
(Continued)

(58) Field of Classification Search
None
See application file for complete search history.

(56) References Cited

U.S. PATENT DOCUMENTS 4,812,017 A * 3/1989 Piper ..... G02F 1/133514 349/144
8,933,976 B2 * 1/2015 Huang ..... H04N 13/0402 345/695
(Continued)

FOREIGN PATENT DOCUMENTS

CN 101000740 7/2007
CN 102636894 8/2012
(Continued)

OTHER PUBLICATIONS

First Office Action issued in corresponding Chinese Application No. 2014100403021 dated May 29, 2015.
(Continued)

*Primary Examiner* — Joseph Haley
*Assistant Examiner* — Emily Frank
(74) *Attorney, Agent, or Firm* — Brooks Kushman P.C.

(57) ABSTRACT

The present disclosure provides an array substrate including a plurality of subpixel array arranged in a matrix form. Each subpixel array may include a first subpixel, a second subpixel, a third subpixel, a first gate line for controlling the first subpixel, a second gate line for controlling the second subpixel, a third gate line for controlling the third subpixel, a first data line and a second data line. The first subpixel may be arranged between the first gate line and the second gate line. The second subpixel and the third subpixel may be arranged between the first gate line and the second gate line.
(Continued)

The first subpixel, the second subpixel and the third subpixel may be arranged between the first data line and the second data line adjacent to each other. The first subpixel and the second subpixel may share the first data line, or the first subpixel and the third subpixel may share the second data line.

22 Claims, 3 Drawing Sheets

(51) Int. Cl.
*G09G 5/10* (2006.01)
*G09G 3/20* (2006.01)
*G09G 3/3225* (2016.01)

(52) U.S. Cl.
CPC ..... *G09G 5/10* (2013.01); *G09G 2300/0426* (2013.01); *G09G 2300/0452* (2013.01); *G09G 2310/08* (2013.01); *G09G 2320/0242* (2013.01); *G09G 2340/0457* (2013.01); *G09G 2340/06* (2013.01)

(56) References Cited

U.S. PATENT DOCUMENTS

2012/0212401 A1* 8/2012 Bae ..... G09G 3/3648 345/88
2013/0112960 A1* 5/2013 Chaji ..... H01L 51/50 257/40
2013/0307868 A1* 11/2013 Jeong ..... G09G 5/02 345/600
2014/0204008 A1* 7/2014 Chu-Ke ..... G09G 3/2003 345/88
2014/0204321 A1* 7/2014 Koh ..... G02F 1/133514 349/109
2016/0240593 A1* 8/2016 Gu ..... G09G 3/3225

FOREIGN PATENT DOCUMENTS

| | | |
|---|---|---|
| CN | 103123430 | 5/2013 |
| CN | 203038924 | 7/2013 |
| CN | 103257494 | 8/2013 |
| CN | 203134285 | 8/2013 |
| CN | 103529614 | 1/2014 |
| CN | 103778888 | 5/2014 |
| KR | 20110026786 | 3/2011 |

OTHER PUBLICATIONS

International Search Report and Written Opinion issued in corresponding International Application No. PCT/CN2014/081552 dated Oct. 27, 2014.

* cited by examiner

-PRIOR ART-

ARRAY SUBSTRATE, ITS DRIVING METHOD, AND DISPLAY DEVICE

CROSS-REFERENCE TO RELATED APPLICATION

The present application is the U.S. national phase of PCT Application No. PCT/CN2014/081552 filed on Jul. 3, 2014, which claims a priority of the Chinese patent application No. 201410040302.1 filed on Jan. 27, 2014, which is incorporated herein by reference in its entirety.

TECHNICAL FIELD

The present disclosure relates to the field of display technology, in particular to an array substrate, its driving method, and a display device.

BACKGROUND

For an existing mobile phone with an organic light-emitting diode (OLED), red, green and blue (RGB) subpixels are arranged in a RGB Pentile waveform arrangement mode, which is different from a standard RGB arrangement mode for an individual pixel point. The pixel point in the standard RGB arrangement mode consists of three subpixels, i.e., the RGB subpixels, while an individual pixel point in the RGB waveform arrangement mode merely consists of two subpixels, i.e., the red and green subpixels, or the blue and green subpixels. When 3×3 subpixels are displayed, merely six subpixels are arranged in a horizontal direction in the RGB waveform arrangement mode, while nine subpixels are arranged in the horizontal direction in the standard RGB arrangement mode. Hence, as compared with the subpixels in the standard RGB arrangement mode, the number of the subpixels in the RGB waveform arrangement mode is reduced by ⅓. During the actual display of an image, one pixel point in the RGB waveform arrangement mode will "borrow" another color from an adjacent pixel point to constitute the three primary colors, and each pixel and the adjacent pixel in the horizontal direction each shares the subpixel pixel in the color that they do not include, respectively, so as to achieve the white display.

As shown in FIG. 1, when the RGB waveform arrangement mode is used, for the display of black-and-white boundaries tilted at 45°, there is such a situation for the leftmost boundary where the RB pixels are arranged alternately in a vertical direction, resulting in such an obvious phenomenon as "color edge". To modify this situation, some subpixels that should have been turned off will be turned on instead, so as to artificially create some adjacent pixels, thereby to achieve the normal color display. However, at this time, the edge that should have been smooth will have a zigzag shape, and this is just the reason why burrs occur at the edge in the RGB waveform arrangement mode. In FIG. 1, R, G and B represent the red subpixel, the green subpixel and the blue subpixel, respectively.

When the RGB waveform arrangement mode is used and it is required to display a detailed content, the resolution will be degraded dramatically, and as a result, it is unable to display a fine font clearly. In order to compensate for the color problem, when a color segmentation area is displayed, a serrated pattern with a width twice an actual pixel pitch will occur at a segment line, i.e., a serrated edge will occur. Moreover, if the content to be displayed is not in a white color, a lattice-like spot with a diameter twice the pixel pitch will occur.

SUMMARY

Technical Problem to be Solved

A main object of the present disclosure is to provide an array substrate, its driving method and a display device, so as to reduce the number of subpixels to simulate a high resolution by using a low resolution and virtually generate more rows to be displayed, while preventing incomplete color display at a segment line and the occurrence of lattice-like spots when a pure color image is displayed in the related art.

Technical Solutions

In one aspect, the present disclosure provides in one embodiment an array substrate, including a plurality of subpixel arrays arranged in a matrix form. Each subpixel array may include a first subpixel, a second subpixel, a third subpixel, a first gate line for controlling the first subpixel, a second gate line for controlling the second subpixel, a third gate line for controlling the third subpixel, a first data line and a second data line. The first subpixel may be arranged between the first gate line and the second gate line. The second subpixel and the third subpixel may be arranged between the second gate line and the third gate line. The first subpixel, the second subpixel and the third subpixel may be arranged between the first data line and the second data line adjacent to each other. The first subpixel may share one of the first data line and the second data line with one of the second subpixel and the third subpixel.

In addition, the second data line of the subpixel array may be the same as the first data line of the adjacent subpixel array.

In addition, when the first subpixel and the second subpixel share the first data line, the first subpixel may include a first pixel electrode and a thin film transistor (TFT), a gate electrode of which is connected to the first gate line, a drain electrode of which is connected to the first data line, and a source electrode of which is connected to the first pixel electrode;

the second subpixel may include a second pixel electrode and a TFT, a gate electrode of which is connected to the second gate line, a drain electrode of which is connected to the first data line, and a source electrode of which is connected to the second pixel electrode; and the third subpixel may include a third pixel electrode and a TFT, a gate electrode of which is connected to the third gate line, a drain electrode of which is connected to the second data line, and a source electrode of which is connected to the third pixel electrode.

In addition, when the first subpixel and the third subpixel share the second data line, the first subpixel may include a first pixel electrode and a TFT, a gate electrode of which is connected to the first gate line, a drain electrode of which is connected to the second data line, and a source electrode of which is connected to the first pixel electrode;

the second subpixel may include a second pixel electrode and a TFT, a gate electrode of which is connected to the second gate line, a drain electrode of which is connected to the first data line, and a source electrode of which is connected to the second pixel electrode; and the third subpixel may include a third pixel electrode and a TFT, a gate electrode of which is connected to the third gate line, a drain electrode of which is connected to the second data line, and a source electrode of which is connected to the third pixel electrode.

In addition, the first subpixel, the second subpixel and the third subpixel may be a red subpixel, a green subpixel and a blue subpixel, respectively.

In addition, the first subpixel, the second subpixel and the third subpixel may be a green subpixel, a blue subpixel and a red subpixel, respectively.

In addition, the first subpixel, the second subpixel and the third subpixel may be a blue subpixel, a red subpixel and a green subpixel, respectively.

In another aspect, the present disclosure provides in one embodiment a display device including the above-mentioned array substrate.

In yet another aspect, the present disclosure provides in one embodiment a method for driving an array substrate which includes a plurality of subpixel arrays arranged in a matrix form. Each subpixel array may include a first subpixel, a second subpixel, a third subpixel, a first gate line for controlling the first subpixel, a second gate line for controlling the second subpixel, a third gate line for controlling the third subpixel, a first data line and a second data line. The first subpixel may be arranged between the first gate line and the second gate line. The second subpixel and the third subpixel may be arranged between the second gate line and the third gate line. The first subpixel, the second subpixel and the third subpixel may be arranged between the first data line and the second data line adjacent to each other. The first subpixel may share one of the first data line and the second data line with one of the second subpixel and the third subpixel.

When the first subpixel and the second subpixel share the first data line, the driving method further includes:

scanning progressively the first gate line, the second gate line and the third gate line of the subpixel array in an $i^{th}$ row;

scanning repeatedly the second gate line and the third gate line of the subpixel array in the $i^{th}$ row, and then scanning the first gate line of the subpixel array in an $(i+1)^{th}$ row;

scanning the first gate line, the second gate line and the third gate line of the subpixel array in the $(i+1)^{th}$ row;

scanning repeatedly the second gate line and the third gate line of the subpixel array in the $(i+1)^{th}$ row, and then scanning the first gate line of the subpixel array in an $(i+2)^{th}$ row; and scanning the first gate line, the second gate line and the third gate line of the subpixel array in the $(i+2)^{th}$ row, where $0<i<n$, and both i and n are positive integers.

Alternatively, when the first subpixel and the third subpixel share the second data line, the driving method further includes:

scanning progressively the first gate line, the third gate line and the second gate line of the subpixel array in an $i^{th}$ row;

scanning repeatedly the third gate line and the second gate line of the subpixel array in the $i^{th}$ row, and then scanning the first gate line of the subpixel array in an $(i+1)^{th}$ row;

scanning the first gate line, the third gate line and the second gate line of the subpixel array in the $(i+1)^{th}$ row;

scanning repeatedly the third gate line and the second gate line of the subpixel array in the $(i+1)^{th}$ row, and then scanning the first gate line of the subpixel array in an $(i+2)^{th}$ row; and scanning the first gate line, the third gate line and the second gate line of the subpixel array in the $(i+2)^{th}$ row, where $0<i<n$, and both i and n are positive integers.

In addition, the adjacent subpixel arrays may share at least one subpixel.

Advantageous Effects

The present disclosure at least has the following advantageous effects. As compared with the related art, the adjacent subpixel arrays in the present disclosure share at least one subpixel, so as to overlap the images to be displayed on a space and time basis and reduce the number of the subpixels, thereby to simulate a high resolution by using a low resolution and virtually generate more rows to be displayed. In addition, it is able to ensure that each pixel consists of the first subpixel, the second subpixel and the third subpixel, thereby to prevent obvious degradation of the resolution, the incomplete color display at the segment line, and the occurrence of the lattice-like spots when the pure color image is displayed.

BRIEF DESCRIPTION OF THE DRAWINGS

In order to illustrate the technical solutions of the present disclosure or the related art in a more apparent manner, the drawings desired for the embodiments of the present disclosure will be described briefly hereinafter. Obviously, the following drawings merely relate to some embodiments of the present disclosure, and based on these drawings, a person skilled in the art may obtain the other drawings without any creative effort.

DETAILED DESCRIPTION

The present disclosure will be described hereinafter in conjunction with the drawings and the embodiments. The following embodiments are for illustrative purposes only, but shall not be used to limit the scope of the present disclosure.

In order to make the objects, the technical solutions and the advantages of the present disclosure more apparent, the present disclosure will be described hereinafter in a clear and complete manner in conjunction with the drawings. Obviously, the following embodiments are merely a part of, rather than all of, the embodiments of the present disclosure, and based on these embodiments, a person skilled in the art may obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

First Embodiment

An array substrate according to the first embodiment of the present disclosure includes a plurality of subpixel arrays arranged in a matrix form.

Figure 1:
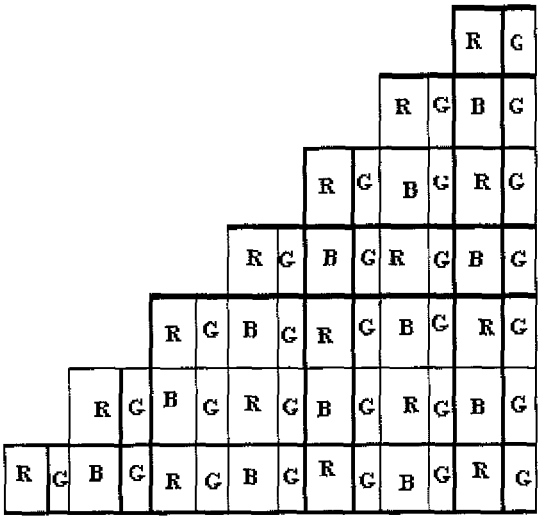
FIG. 1 is a schematic view showing an RGB waveform arrangement mode for a color filter array in the related art.
Figure 2:
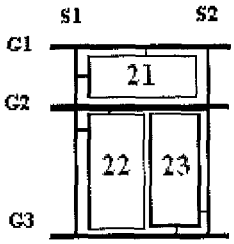
FIG. 2 is a schematic view showing one subpixel array included in an array substrate according to the first embodiment of the present disclosure.

To be specific, as shown in FIG. 2, the subpixel array includes a first subpixel 21, a second subpixel 22, a third subpixel 23, a first gate line G1 for controlling the first subpixel 21, a second gate line G2 for controlling the second subpixel 22, a third gate line G3 for controlling the third subpixel 23, a first data line S1 and a second data line S2. The first subpixel 21 is arranged between the first gate line G1 and the second gate line G2. The second subpixel 22 and the third subpixel 23 are arranged between the second gate line G2 and the third gate line G3. The first subpixel 21, the second subpixel 22 and the third subpixel 23 are arranged between the first data line S1 and the second data line S2. The first subpixel 21 and the second subpixel 22 share the first data line S1.

In FIG. 2, G1, G2, G3, S1 and S2 refer to, in general, the first gate line, the second gate line, the third gate line, the first data line and the second data line included in each subpixel array, respectively.

According to the array substrate in this embodiment, the adjacent pixels share at least one subpixel, so as to overlap the images to be displayed on a space and time basis and reduce the number of the subpixels, thereby to simulate a high resolution by using a low resolution and virtually generate more rows to be displayed. In addition, it is able to ensure that each pixel consists of the first subpixel, the second subpixel and the third subpixel, thereby to prevent obvious degradation of the resolution, the incomplete color display at a segment line, and the occurrence of lattice-like spots when a pure color image is displayed.

Second Embodiment

In this embodiment, which is provided on the basis of the first embodiment, the second data line of the subpixel array is the same as the first data line of an adjacent subpixel array.

Third Embodiment

In this embodiment, which is provided on the basis of the first embodiment or the second embodiment, the first subpixel includes a first pixel electrode and a TFT, a gate electrode of which is connected to the first gate line, a drain electrode of which is connected to the first data line, and a source electrode of which is connected to the first pixel electrode. The second subpixel includes a second pixel electrode and a TFT, a gate electrode of which is connected to the second gate line, a drain electrode of which is connected to the first data line, and a source electrode of which is connected to the second pixel electrode. The third subpixel includes a third pixel electrode and a TFT, a gate electrode of which is connected to the third gate line, a drain electrode of which is connected to the second data line, and a source electrode of which is connected to the third pixel electrode.

To be specific, the first subpixel, the second subpixel and the third subpixel may be a red subpixel, a green subpixel and a blue subpixel, respectively. Alternatively, the first subpixel, the second subpixel and the third subpixel may be a green subpixel, a blue subpixel and a red subpixel, respectively. Alternatively, the first subpixel, the second subpixel and the third subpixel may be a blue subpixel, a red subpixel and a green subpixel, respectively.

Fourth Embodiment

Figure 3:
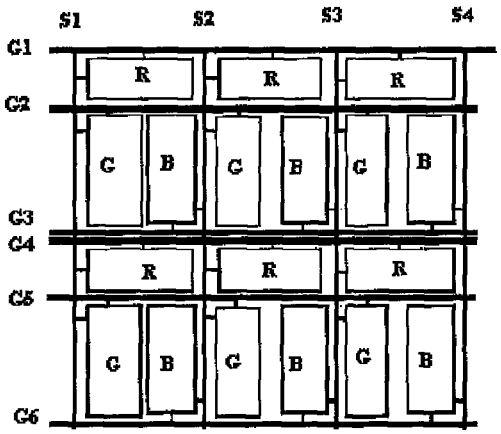
FIG. 3 is a schematic view showing a plurality of subpixel arrays included in the array substrate according to the fourth embodiment of the present disclosure.

This embodiment is provided on the basis of the first, second and third embodiments. As shown in FIG. 3, the first subpixel, the second subpixel and the third subpixel are a red subpixel, a green subpixel and a blue subpixel, which are represented by R, G and B, respectively. G1, G2, G3, G4, G5, G6 and G7 represent the first gate line, the second gate line, the third gate line, a fourth gate line, a fifth gate line, a sixth gate line and a seventh gate line, respectively. S1, S2, S3 and S4 represent the first data line, the second data line, a third data line and a fourth data line, respectively.

In FIG. 3, the subpixel array in a first row includes a red subpixel controlled by G1, a green subpixel controlled by G2 and a blue subpixel controlled by G3; the subpixel array in a second row includes a green subpixel controlled by G2, a blue subpixel controlled by G3 and a red subpixel controlled by G4; the subpixel array in a third row includes a red subpixel controlled by G4, a green subpixel controlled by G5 and a blue subpixel controlled by G6; the fourth subpixel array in a fourth row includes a green subpixel controlled by G5, a blue subpixel controlled by G6 and a red subpixel controlled by G7, and so on. In this way, apart from the subpixel controlled by the first gate line and that controlled by the last gate line, the subpixels controlled by the other gate lines may serve as the subpixels shared by any two adjacent subpixel arrays, so as to increase the virtual display resolution for a screen. When there are N original pixels (N is an integer greater than or equal to 2), the number of pixels will be increased to 3N/2 when the subpixels are shared by the adjacent subpixel arrays in this embodiment.

Figure 4:
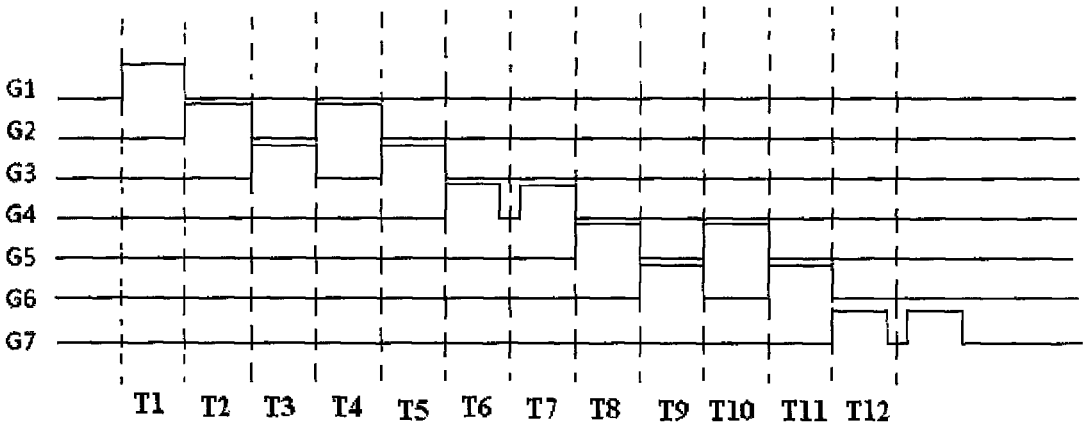
FIG. 4 is a sequence diagram for scanning gate electrodes included in the array substrate according to the fourth embodiment of the present disclosure.

In FIG. 4, which is a sequence diagram for scanning the gate electrodes included in the array substrate according to the fourth embodiment of the present disclosure, T1, T2, T3, T4, T5, T6, T7, T8, T9, T10, T11 and T12 represent a first clock cycle, a second clock cycle, a third clock cycle, a fourth clock cycle, a fifth clock cycle, a sixth clock cycle, a seventh clock cycle, an eighth clock cycle, a ninth clock cycle, a tenth clock cycle, an eleventh clock cycle and a twelfth clock cycle, respectively. Referring to FIG. 4, G1, G2 and G3 are scanned sequentially within T1, T2 and T3; G2, G3 and G4 are scanned sequentially within T4, T5 and T6; G4, G5, G6 are scanned sequentially within T7, T8 and T9; and G5, G6 and G7 are scanned sequentially within T10, T11 and T12.

The present disclosure further provides in one embodiment a method for driving the array substrate mentioned in the first embodiment, the second embodiment or the third embodiment. In the driving method, the adjacent subpixel arrays share at least one subpixel.

Alternatively, when the array substrate includes a plurality of rows of n subpixel arrays arranged in a matrix form, the driving method further includes:

scanning progressively the first gate line, the second gate line and the third gate line of the subpixel array in an $i^{th}$ row;

scanning repeatedly the second gate line and the third gate line of the subpixel array in the $i^{th}$ row, and then scanning the first gate line of the subpixel array in an $(i+1)^{th}$ row;

scanning the first gate line, the second gate line and the third gate line of the subpixel array in the $(i+1)^{th}$ row;

scanning repeatedly the second gate line and the third gate line of the subpixel array in the $(i+1)^{th}$ row, and then scanning the first gate line of the subpixel array in an $(i+2)^{th}$ row; and scanning the first gate line, the second gate line and the third gate line of the subpixel array in the $(i+2)^{th}$ row, where $0<i<n$, and both i and n are positive integers.

Fifth Embodiment

In this embodiment, the array substrate includes a plurality of subpixel arrays arranged in a matrix form.

Figure 5:
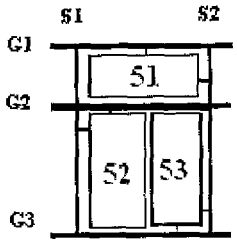
FIG. 5 is a schematic view showing one subpixel array included in the array substrate according to the fifth embodiment of the present disclosure.

As shown in FIG. 5, the subpixel array includes a first subpixel 51, a second subpixel 52, a third subpixel 53, a first gate line G1 for controlling the first subpixel 51, a second gate line G2 for controlling the second subpixel 52, a third gate line G3 for controlling the third subpixel 53, a first data line S1, and a second data line S2. The first subpixel 51 is arranged between the first gate line G1 and the second gate line G2. The second subpixel 52 and the third subpixel 53 are arranged between the second gate line G2 and the third gate line G3. The first subpixel 51, the second subpixel 52 and the third subpixel 53 are arranged between the first data line S1 and the second data line S2 adjacent to each other. The first subpixel 51 and the third subpixel 53 share the second data line S2.

According to the array substrate in this embodiment, the adjacent pixels share at least one subpixel, so as to overlap the images to be displayed on a space and time basis and reduce the number of the subpixels, thereby to simulate a high resolution by using a low resolution and virtually generate more rows to be displayed. In addition, it is able to ensure that each pixel consists of the first subpixel, the second subpixel and the third subpixel, thereby to prevent obvious degradation of the resolution, the incomplete color display at the segment line, and the occurrence of the lattice-like spots when the pure color image is displayed.

Sixth Embodiment

In this embodiment, which is provided on the basis of the fifth embodiment, the second data line of the subpixel array is the same as the first data line of an adjacent subpixel array.

Seventh Embodiment

In this embodiment, which is provided on the basis of the fifth or sixth embodiment, the first subpixel includes a first pixel electrode and a TFT, a gate electrode of which is connected to the first gate line, a drain electrode of which is connected to the second data line and a source electrode of which is connected to the first pixel electrode. The second subpixel includes a second pixel electrode and a TFT, a gate electrode of which is connected to the second gate line, a drain electrode of which is connected to the first data line, and a source electrode of which is connected to the second pixel electrode. The third subpixel includes a third pixel electrode and a TFT, a gate electrode of which is connected to the third gate line, a drain electrode of which is connected to the second data line, and a source electrode of which is connected to the third pixel electrode.

To be specific, the first subpixel, the second subpixel and the third subpixel may be a red subpixel, a green subpixel and a blue subpixel, respectively. Alternatively, the first subpixel, the second subpixel and the third subpixel may be a green subpixel, a blue subpixel and a red subpixel, respectively. Alternatively, the first subpixel, the second subpixel and the third subpixel may be a blue subpixel, a red subpixel and a green subpixel, respectively.

The present disclosure further provides in one embodiment the method for driving the array substrate mentioned in the fifth, sixth and seventh embodiments of the present disclosure. In this driving method, the adjacent subpixel arrays share at least one subpixel.

Alternatively, when the array substrate includes a plurality of rows of n subpixel arrays arranged in a matrix form, the driving method further includes:

scanning progressively the first gate line, the third gate line and the second gate line of the subpixel array in an $i^{th}$ row;

scanning repeatedly the third gate line and the second gate line of the subpixel array in the $i^{th}$ row, and then scanning the first gate line of the subpixel array in an $(i+1)^{th}$ row;

scanning the first gate line, the third gate line and the second gate line of the subpixel array in the $(i+1)^{th}$ row;

scanning repeatedly the third gate line and the second gate line of the subpixel array in the $(i+1)^{th}$ row, and then scanning the first gate line of the subpixel array in an $(i+2)^{th}$ row; and scanning the first gate line, the third gate line and the second gate line of the subpixel array in the $(i+2)^{th}$ row, where $0<i<n$, and both i and n are positive integers.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. An array substrate, comprising a plurality of subpixel arrays arranged in a matrix form, each subpixel array comprising a first subpixel, a second subpixel, a third subpixel, a first gate line for controlling the first subpixel, a second gate line for controlling the second subpixel, a third gate line for controlling the third subpixel, a first data line and a second data line, wherein the first subpixel is arranged between the first gate line and the second gate line, the second subpixel and the third subpixel are arranged between the second gate line and the third gate line, the first subpixel, the second subpixel and the third subpixel are arranged between the first data line and the second data line adjacent to each other, and the first subpixel shares one of the first data line and the second data line with one of the second subpixel and the third subpixel, wherein two adjacent subpixel arrays share at least one subpixel, and the shared at least one subpixel is a subpixel in both of the two adjacent subpixel arrays.

2. The array substrate according to claim 1, wherein the second data line of the subpixel array is the same as the first data line of the adjacent subpixel array.

3. The array substrate according to claim 1, wherein when the first subpixel and the second subpixel share the first data line, the first subpixel includes a first pixel electrode and a thin film transistor (TFT), a gate electrode of which is connected to the first gate line, a drain electrode of which is connected to the first data line, and a source electrode of which is connected to the first pixel electrode.

4. The array substrate according to claim 1, wherein when the first subpixel and the second subpixel share the first data line, the second subpixel includes a second pixel electrode and a TFT, a gate electrode of which is connected to the second gate line, a drain electrode of which is connected to the first data line, and a source electrode of which is connected to the second pixel electrode.

5. The array substrate according to claim 1, wherein when the first subpixel and the second subpixel share the first data line, the third subpixel includes a third pixel electrode and a TFT, a gate electrode of which is connected to the third gate line, a drain electrode of which is connected to the second data line, and a source electrode of which is connected to the third pixel electrode.

6. The array substrate according to claim 1, wherein when the first subpixel and the third subpixel share the second data line, the first subpixel includes a first pixel electrode and a TFT, a gate electrode of which is connected to the first gate line, a drain electrode of which is connected to the second data line, and a source electrode of which is connected to the first pixel electrode.

7. The array substrate according to claim 1, wherein when the first subpixel and the third subpixel share the second data line, the second subpixel includes a second pixel electrode and a TFT, a gate electrode of which is connected to the second gate line, a drain electrode of which is connected to the first data line, and a source electrode of which is connected to the second pixel electrode.

8. The array substrate according to claim 1, wherein when the first subpixel and the third subpixel share the second data line, the third subpixel includes a third pixel electrode and a TFT, a gate electrode of which is connected to the third gate line, a drain electrode of which is connected to the second data line, and a source electrode of which is connected to the third pixel electrode.

9. The array substrate according to claim 1, wherein the first subpixel, the second subpixel and the third subpixel are a red subpixel, a green subpixel and a blue subpixel, respectively.

10. The array substrate according to claim 1, wherein the first subpixel, the second subpixel and the third subpixel are a green subpixel, a blue subpixel and a red subpixel, respectively.

11. The array substrate according to claim 1, wherein the first subpixel, the second subpixel and the third subpixel are a blue subpixel, a red subpixel and a green subpixel, respectively.

12. A method for driving an array substrate which comprises a plurality of subpixel arrays arranged in a matrix form, each subpixel array comprising a first subpixel, a second subpixel, a third subpixel, a first gate line for controlling the first subpixel, a second gate line for controlling the second subpixel, a third gate line for controlling the third subpixel, a first data line and a second data line, wherein the first subpixel is arranged between the first gate line and the second gate line, the second subpixel and the third subpixel are arranged between the second gate line and the third gate line, the first subpixel, the second subpixel and the third subpixel are arranged between the first data line and the second data line adjacent to each other, and the first subpixel shares one of the first data line and the second data line with one of the second subpixel and the third subpixel, wherein when the first subpixel and the second subpixel share the first data line, the method further comprises:

scanning progressively the first gate line, the second gate line and the third gate line of the subpixel array in an ith row;

scanning repeatedly the second gate line and the third gate line of the subpixel array in the ith row, and then scanning the first gate line of the subpixel array in an (i+1)th row;

scanning the first gate line, the second gate line and the third gate line of the subpixel array in the (i+1)th row;

scanning repeatedly the second gate line and the third gate line of the subpixel array in the (i+1)th row, and then scanning the first gate line of the subpixel array in an (i+2)th row; and scanning the first gate line, the second gate line and the third gate line of the subpixel array in the (i+2)th row, where $0<i<n$, and both i and n are positive integers, or when the first subpixel and the third subpixel share the second data line, the method further comprises:

scanning progressively the first gate line, the third gate line and the second gate line of the subpixel array in an ith row;

scanning repeatedly the third gate line and the second gate line of the subpixel array in the ith row, and then scanning the first gate line of the subpixel array in an (i+1)th row;

scanning the first gate line, the third gate line and the second gate line of the subpixel array in the (i+1)th row;

scanning repeatedly the third gate line and the second gate line of the subpixel array in the (i+1)th row, and then scanning the first gate line of the subpixel array in an (i+2)th row; and scanning the first gate line, the third gate line and the second gate line of the subpixel array in the (i+2)th row, where $0<i<n$, and both i and n are positive integers.

13. The method according to claim 12, wherein adjacent subpixel arrays share at least one subpixel.

14. A display device, comprising an array substrate, wherein the array substrate comprises a plurality of subpixel arrays arranged in a matrix form, each subpixel array comprising a first subpixel, a second subpixel, a third subpixel, a first gate line for controlling the first subpixel, a second gate line for controlling the second subpixel, a third gate line for controlling the third subpixel, a first data line and a second data line, wherein the first subpixel is arranged between the first gate line and the second gate line, the second subpixel and the third subpixel are arranged between the second gate line and the third gate line, the first subpixel, the second subpixel and the third subpixel are arranged between the first data line and the second data line adjacent to each other, and the first subpixel shares one of the first data line and the second data line with one of the second subpixel and the third subpixel, wherein two adjacent subpixel arrays share at least one subpixel, and the shared at least one subpixel is a subpixel in both of the two adjacent subpixel arrays.

15. The display device according to claim 14, wherein the second data line of the subpixel array is the same as the first data line of the adjacent subpixel array.

16. The display device according to claim 14, wherein when the first subpixel and the second subpixel share the first data line, the first subpixel includes a first pixel electrode and a thin film transistor (TFT), a gate electrode of which is connected to the first gate line, a drain electrode of which is connected to the first data line, and a source electrode of which is connected to the first pixel electrode.

17. The display device according to claim 14, wherein when the first subpixel and the second subpixel share the first data line, the second subpixel includes a second pixel electrode and a TFT, a gate electrode of which is connected to the second gate line, a drain electrode of which is connected to the first data line, and a source electrode of which is connected to the second pixel electrode.

18. The display device according to claim 14, wherein when the first subpixel and the second subpixel share the first data line, the third subpixel includes a third pixel electrode and a TFT, a gate electrode of which is connected to the third gate line, a drain electrode of which is connected to the second data line, and a source electrode of which is connected to the third pixel electrode.

19. The display device according to claim 14, wherein when the first subpixel and the third subpixel share the second data line, the first subpixel includes a first pixel electrode and a TFT, a gate electrode of which is connected to the first gate line, a drain electrode of which is connected to the second data line, and a source electrode of which is connected to the first pixel electrode.

20. The display device according to claim 14, wherein when the first subpixel and the third subpixel share the second data line, the second subpixel includes a second pixel electrode and a TFT, a gate electrode of which is connected to the second gate line, a drain electrode of which is connected to the first data line, and a source electrode of which is connected to the second pixel electrode.

21. The display device according to claim 14, wherein when the first subpixel and the third subpixel share the second data line, the third subpixel includes a third pixel electrode and a TFT, a gate electrode of which is connected to the third gate line, a drain electrode of which is connected to the second data line, and a source electrode of which is connected to the third pixel electrode.

22. The display device according to claim 14, wherein the first subpixel, the second subpixel and the third subpixel are a red subpixel, a green subpixel and a blue subpixel, respectively; or wherein the first subpixel, the second subpixel and the third subpixel are a green subpixel, a blue subpixel and a red subpixel, respectively; or wherein the first subpixel, the second subpixel and the third subpixel are a blue subpixel, a red subpixel and a green subpixel, respectively.

* * * * *